United States Patent [19]

Williams, Jr.

[11] Patent Number: 4,660,916

[45] Date of Patent: Apr. 28, 1987

[54] LAMPHOLDER GASKET

[75] Inventor: Howard M. Williams, Jr., Emmaus, Pa.

[73] Assignee: Hubbell-Bell Inc., Orange, Conn.

[21] Appl. No.: 765,012

[22] Filed: Aug. 9, 1985

[51] Int. Cl.[4] ..... H01R 4/00

[52] U.S. Cl. ..... 339/94 L; 339/59 L; 339/61 L

[58] Field of Search ..... 339/59, 60, 94 L, 176 L, 339/182 L, 185 RL, 189 L, 191 L, 192 RL, 195 L

[56] References Cited

U.S. PATENT DOCUMENTS

| | | | |
|---|---|---|---|
| 382,110 | 5/1888 | Reilly | 339/94 L |
| 2,015,590 | 9/1935 | Cavanaugh et al. | 339/60 R |
| 2,099,405 | 11/1937 | Langdon | 339/59 L |
| 2,708,714 | 5/1955 | Stevens, Jr. | 339/59 L |
| 4,166,664 | 9/1979 | Herrmann, Jr. | 339/60 M |

FOREIGN PATENT DOCUMENTS

| | | | |
|---|---|---|---|
| 6406978 | 12/1965 | Netherlands | 339/94 L |
| 119539 | 10/1918 | United Kingdom | 339/94 L |

*Primary Examiner*—Gil Weidenfeld
*Assistant Examiner*—David Pirlot
*Attorney, Agent, or Firm*—Jerry M. Presson; Walter C. Farley; Stephen A. Litchfield

[57] ABSTRACT

The gasket for forming a weather resistant seal between a lamp and a lampholder having a socket therein, said gasket comprising a circular ring of flexible water resistant material and having a preformed section therein for mounting the gasket around the exterior of a lampholder and connecting said preformed section to a lip in the lampholder, said gasket also including a reduced cross-sectional area in the portion adjacent the lamp such that the reduced cross-sectional area readily provides a flexible member adjacent the lamp for forming a weather resistant seal.

2 Claims, 8 Drawing Figures

LAMPHOLDER GASKET

BACKGROUND OF THE INVENTION

This invention relates in general to rubber or flexible material gaskets for lamps and the like and in particular, to gaskets designed for use in combination with lamps and lampholders for outdoor use to help seal out moisture and debris.

Conventional gaskets in the past have comprised generally a round piece of rubber designed to fit between the interior of the lampholder and the exterior portion of the lamp, or electric bulb. An example of such a gasket is shown in U.S. Pat. No. 819,437 to Jones. As can be seen in this reference, the gasket is no more than a circular gasket having a circular cross-section fitting between the exterior of the lamp and the interior of the lampholder. Additional gaskets are shown in U.S. Pat. No. 3,519,811 to Jacobs, U.S. Pat. No. 536,792 to Soden and U.S. Pat. No. 1,933,511 to Manson. These patents illustrate gaskets disposed between the exterior of the lamp and the interior of the lampholder assembly, Jacobs shows a gasket having a circular cross-section similar to Jones. Soden and Manson show an insulating or water proofing material having a shape that approximates that of the interior lamp assembly. An additional lampholder gasket is shown in the patent to Sternaman, No. 2,699,491, and has a rectangular cross-section but again is displaced between the lamp bulb and the interior of the lampholder.

These prior art gaskets are all disposed between the bulb and the lampholder, meaning that when the bulb is replaced there is a possibility that the gasket will be displaced or lost. In the patent to Manson, it appears that the gasket would actually be removed with the bulb as the bulb is being replaced rather than remaining an integral assembly of the lampholder.

Further, these prior art gasket assemblies, if slightly misplaced within the lampholder, may prevent the bulb from being turned entirely into the socket and thereby preventing a secure electrical contact between the bulb and the socket. In such a case, there is a risk that the bulb may be overtightened into the socket area in an attempt to make electrical contact and thereby fracture or break, causing injury to one who is tightening the bulb. Further, these prior art gaskets do not possess the flexibility required to enable them to accommodate slight deviations in the neck diameters of the electric bulbs inserted therein and still maintain a weather resistant seal between the bulb and the gasket.

Thus, there is a need in the field for a lampholder gasket for use with an outdoor lampholder which will remain with the lampholder when the bulb is changed and which will not interfere with the tightening of the bulb into the lamp socket to make the electrical contact. Further, there is a need in the field for a lampholder gasket that will provide a weather resistant seal to protect the lampholder and its interior electrical elements from damage due to moisture and debris and yet maintain a relatively high degree of flexibility.

OBJECTS OF THE INVENTION

It is therefore an object of the present invention to provide a lampholder gasket which is secured to the lampholder body and which will not be removed upon the replacement of electric bulbs in the lampholder.

It is another object of the present invention to provide a lampholder gasket which will not interfere with the tightening of the bulb into the socket when bulbs are replaced.

It is a further object of the present invention to provide a lampholder gasket which will form a weather resistant seal once a bulb has been installed in the lampholder and which will maintain a relatively high degree of flexibility.

Further objects and advantages of the invention will, in part, become apparent as the following description proceeds. The features of novelty which characterize the invention will be pointed out with particularity in the claims and forming a part hereof.

SUMMARY OF THE INVENTION

The objects of the present invention are accomplished by providing a rubber or other flexible material type gasket which is designed to fit over a lip molded on the exterior portion of a rounded lampholder such that the lip maintains the gasket to the lampholder. The gasket has a uniquely formed inner area having a reduced cross-sectional thickness adjacent to the portion in contact with the electric bulb. The gasket encircles the entire bulb and lampholder and forms a weather resistant seal therewith. This reduced cross-sectional thickness area is formed on the interior of the gasket lip, thus, as the bulb is tightened into the lip it compresses the outer end of the gasket, thereby forming a weather resistant seal against the bulb. The gasket of the present invention will remain with the lampholder as the bulb is replaced due to its fitting over the lip of the lampholder, and does not interfere with the turning of the bulb in the socket to form the electrical connection. Due to the reduced cross-sectional thickness adjacent the area of the bulb the gasket will flex as the bulb is inserted into the lampholder socket and in this manner accommodate slight variations in bulb neck diameter and help form a weather resistant seal.

BRIEF DESCRIPTION OF THE DRAWINGS

The features of the present invention which are believed to be novel are set forth with particularity in the appended claims. The invention together with further objects and advantages thereof may best be understood by reference to the following description, taken in conjunction with the accompanying drawings in the several figures of which like reference numerals identify like elements and in which:

DETAILED DESCRIPTION

Figure 1:
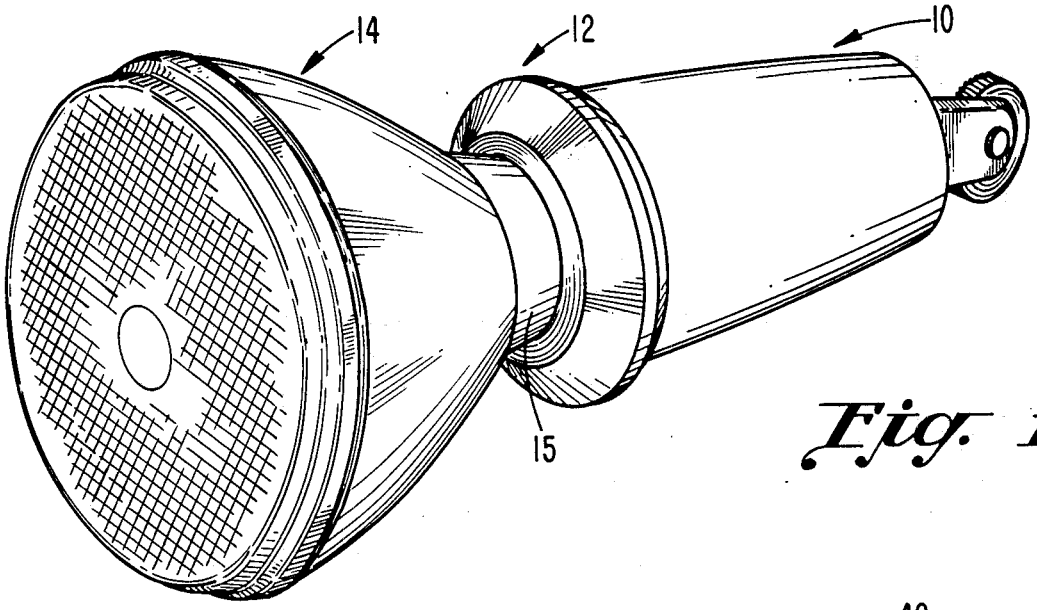
FIG. 1 is a perspective view of a lampholder and bulb showing the gasket mounted therearound.

The lampholder of the present invention and in the best mode is shown in FIG. 1 generally as 10. Gasket 12 is shown disclosed thereover and surrounding the neck 15 of lamp 14. It is seen that gasket 12 has encircled the entire outer end of rounded lampholder 10 and also encircles the entire base of the neck 15 of lamp 14.

Figure 2:
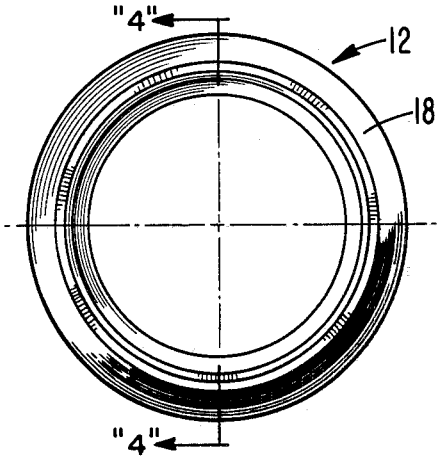
FIG. 2 is a front view of the lampholder gasket.
Figure 3:
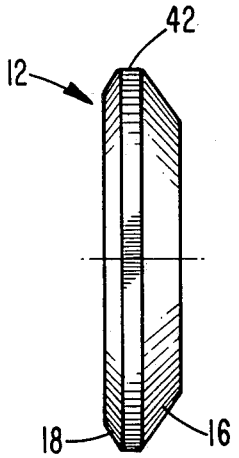
FIG. 3 is a side view of the lampholder gasket.

FIGS. 2 and 3 show the front and side views of gasket 12. FIG. 3 shows the relative sloped angles and lengths of the side 16 and side 18 of gasket 12. Side 16 forms a circular opening in which lamp 14 is disposed. Side 18 forms a circular opening through which the lampholder 10 extends.

Figure 4:
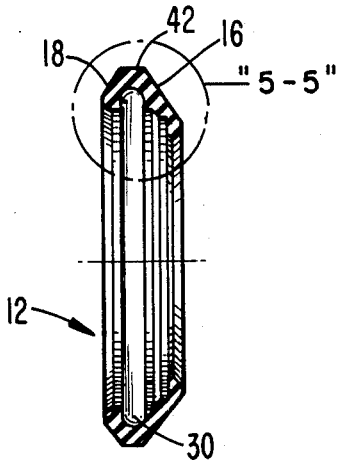
FIG. 4 is a section view taken along section lines 4—4 of FIG. 2.
Figure 5:
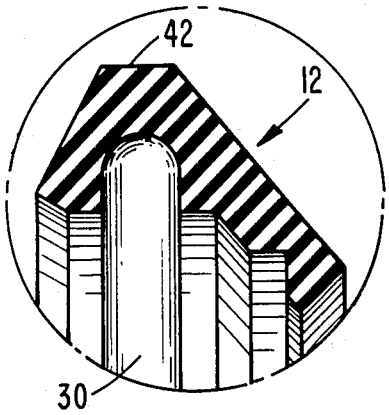
FIG. 5 is an enlarged view taken from section 5—5 of FIG. 4.

FIGS. 4 and 5 show in detail the cross-sectional view of lampholder gasket 12 and show the various configurations of the interior of the gasket 12 which are formed to mate the gasket 12 with the lampholder 10 and to provide a sealing area against which the lamp 14 will compress to form a weather resistant seal.

Figure 6:
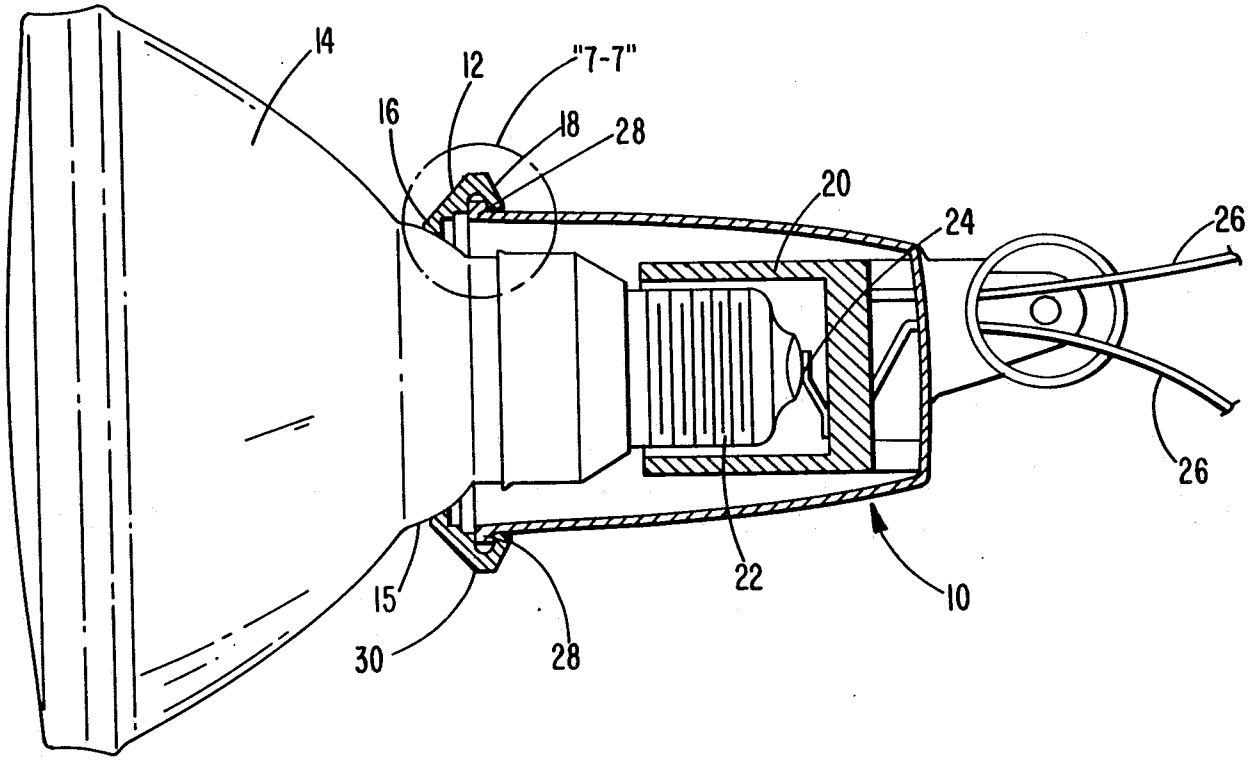
FIG. 6 is an side section view of the lampholder and gasket showing and electric light bulb or lamp connected thereto.

Referring now to FIG. 6, lampholder 10 is shown in cross-sectional view having lamp 14 mounted therein such that socket 20 has the electrical connecting portion 22 of lamp 14 adjacent contact 24, thereby placing the lamp 14 in electrical contact with the source, not shown, which is carried to the socket via wires 26. Gasket 12 is shown in FIG. 6 mounted around the exterior of lampholder 10 and the neck 15 of lamp 14. The shell which forms lampholder 10 has lip 28 which is molded around the outer periphery of the lampholder 10. This lip 28 provides a means by which gasket 12 is attached to lampholder 10 to insure that the gasket 12 remains with lampholder 10 as the lamps 14 are replaced. It is seen in FIG. 6 that the side 16 of gasket 12 is adjacent lamp 14 and side 18 of gasket 12 is adjacent lampholder 10. Gasket 12 has molded therein an open section 30 which receives the lip 28 of lampholder 10.

Figure 7:
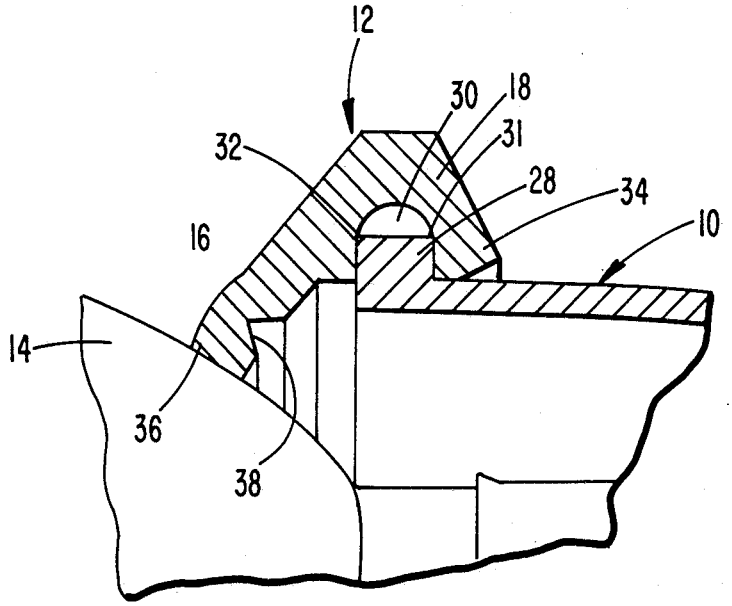
FIG. 7 is an enlarged view of section 7—7 shown in FIG. 6.

Referring now to FIG. 7 it is seen in greater detail that gasket 12 is mounted over lip 28 of lampholder 10 by virtue of the open section 30 in gasket 12. Open section 30 of gasket 12 has side sections 31 and 32 which form tight seals adjacent both sides of lip 28. Gasket 12 has outer end 34 which corresponds to the side 18 of gasket 12 and which forms a weather resistant seal between gasket 12 and the outer periphery of lip 28 of lampholder 10. Lampholder gasket 12 is shown in FIG. 7 having outer end portion 36 which rests adjacent lamp 14 and forms a weather resistant seal therewith as lamp 14 is turned into socket 20. This weather resistant seal is enhanced by virtue of the reduced cross-sectional area 38 formed in the underside of gasket 12. This reduced cross-sectional area 38 is formed in the approximate shape of a right triangle, as shown in more detail in FIG. 8.

Figure 8:
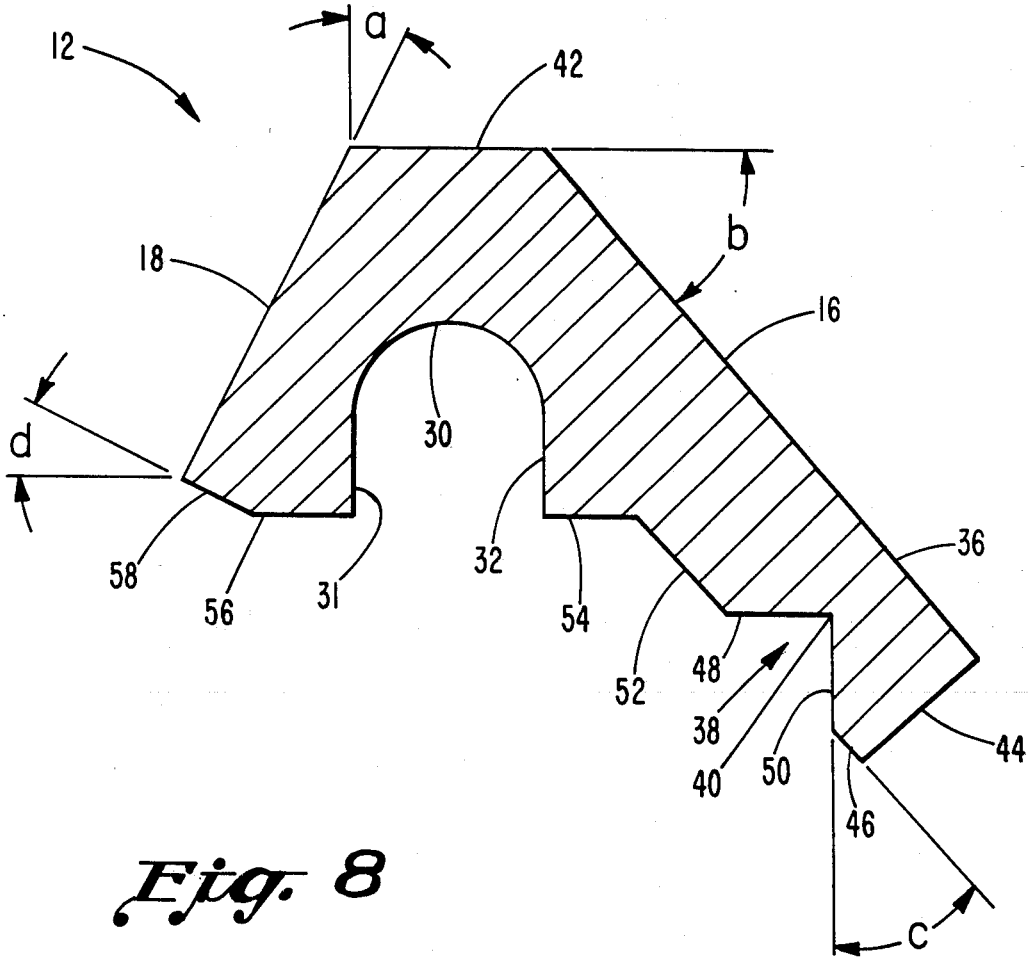
FIG. 8 is a cross-sectional view of the lampholder gasket.

Referring now to FIG. 8, area 38 has the tip of the triangle 40 adjacent the outer end 36 of side 16 of gasket 12. This provides an angular indentation to the cross-section of gasket 12, particularly, to the outer portion 36 of gasket 12 thereby making it weaker at this portion than throughout the rest of the cross-section of the gasket. This facilitates the flexing of the gasket 12 at its outer end 36, as shown in FIG. 7, when lamp 14 is turned into socket 20. It should be noted that in this manner the gasket 12 will not prevent the lamp 14 from being adequately tightened into socket 20 to form an electrical connection.

In the preferred embodiment it is anticipated that this gasket 12 will be used on a Bell Electric Company Catalog No. 330 Lampholder with a PAR-38 type electric lamp. Thus, it is anticipated that for this use gasket 12 will have the following dimensions. In the side section view of FIG. 8 top portion 42 will have a length of 0.125 inches. Side 18 as shown will have a length of 0.240 inches and side 16 will have a length of 0.427 inches. Bottom portion 44 of gasket 12, shown in FIG. 8 will have a length in cross-section of 0.1 inch. Portion 46 of gasket 12 will have a length in cross-section of 0.031 inches. Section 48, forming one of the legs of the triangle for the reduced cross-sectional area 38, will have a length of 0.066 inches. Section 50, forming the other leg of the reduced cross-sectional area 38 has a length of 0.070 inches. These legs intersect at point 40, at approximately a right angle. Section 52 of the underside of gasket 12 has a length of 0.085 inches and section 54 of the underside of gasket 12 has a length of 0.060 inches. Section 56 of the underside of gasket 12 has a length in cross-section of 0.062 inches. Section 58 of the underside of gasket 12 has a length of 0.053 inches. The open section 30 has a width in cross-section of 0.125 inches. Angle "a" shown on the top portion of gasket 12 in FIG. 8 is 27 degrees. Angle "b" shown on the top portion of gasket 12 is 49.5 degrees, angle "C" shown at the bottom portion 44 of gasket 12 is 43 degrees and angle "d" shown at the bottom of side 18 of gasket 12 is 27 degrees. The lampholder gasket 12 is approximately 2.375 inches in overall diameter and has a circular opening on side 16 of approximately 1.593 inches in diameter. The circular opening of said 18 of gasket 12 is approximately 1.968 inches in diameter.

By following the above angles and dimensions, the lampholder gasket 12 may be formed such that it will form a weather resistant seal in lampholder 10 and lamp 14 for a Bell Electric Company Catalog No. 330 Electrical Lampholder and a PAR-38 Electric Lamp.

Of course, other size and dimension lampholder gaskets may be made and may have features other than those described herein depending on the mounting arrangement to the lampholder. Thus, the invention is not limited to the particular details depicted and other modifications and applications are contemplated. For example, the rounded portion 30 of the lampholder gasket 12 could be modified such that the upper portion is flat rather than rounded. It is important though that the sides 31 and 32 form a secure seal with the lip 28 of lampholder 10 to prevent moisture from seeping in around the lip 28 of lampholder 10. Also, the particular angles and dimensions of the gasket 12 in cross-sectional view of FIG. 8 may be modified according to different types of lamps and lampholder structures. It is contemplated that the gasket will be made of a silicone material, however, any suitable type of waterproof, flexible material could be used instead. Certain other changes may be made in the above described invention without departing from the true spirit and scope of the invention herein involved. It is therefore intended that the subject matter in the above description shall be interpreted as illustrative and not in a limiting sense.

I claim:

1. A gasket for forming a seal between a lamp having an electrical connection end portion and an outwardly diverging envelope, and a lampholder having a shell with a circular end opening to receive the lamp, a radially outwardly extending lip surrounding the end opening and socket means within the shell electrically and mechanically engaging the end portion of the lamp, the gasket comprising, an annular ring of resilient elastomeric material having an inner surface and an outer surface;

means defining an annular groove in said inner surface adjacent one axial end of said ring, said means including, in cross section, first and second leg portions and an intermediate portion joining said leg portions, said groove being dimensioned to snugly receive the lip on said shell with said first leg portion abutting an end face of said circular end opening; and a seal member unitarily formed on said first leg portion and extending axially away from said circular end opening on said shell and radially inwardly toward the envelope of said lamp, said seal member having generally conical inner and outer surfaces, and an annular, V-shaped recess formed in said inner surface intermediate the ends of said seal member forming an annular region of increased flexibility relative to the remainder of said seal member to permit the distal portion of said seal member to bend readily when contacted by the lamp envelope whereby a seal is formed with each lamp envelope as lamps are removed from and replaced into said lamp holder.

2. A gasket according to claim 1 wherein said elastomeric material is silicone.

* * * * *